United States Patent [19]

Van Houten

[11] Patent Number: 4,971,520

[45] Date of Patent: Nov. 20, 1990

[54] HIGH EFFICIENCY FAN

[75] Inventor: Robert J. Van Houten, Winchester, Mass.

[73] Assignee: Airflow Research and Manufacturing Corporation, Watertown, Mass.

[21] Appl. No.: 392,347

[22] Filed: Aug. 11, 1989

[51] Int. Cl.[5] ..... F04D 29/38

[52] U.S. Cl. ..... 416/169 A; 416/189; 416/DIG. 5

[58] Field of Search ..... 416/189 R, 238, 169 A, 416/195, DIG. 2, DIG. 5

[56] References Cited

U.S. PATENT DOCUMENTS

| | | | |
|---|---|---|---|
| 652,123 | 6/1900 | Lavigne | 416/235 |
| 1,620,875 | 3/1927 | Currie | 416/237 X |
| 1,706,608 | 3/1929 | Holmes | 416/238 |
| 2,569,632 | 2/1986 | Gray | 416/238 X |
| 2,915,238 | 12/1959 | Szydlowski | 416/242 X |
| 2,936,948 | 5/1960 | Eck | 416/242 X |
| 2,976,352 | 3/1961 | Atalla | 415/119 X |
| 3,014,534 | 12/1961 | Vartiainen | 416/238 |
| 3,111,173 | 11/1963 | Klonoski | 416/195 |
| 3,168,235 | 2/1965 | Valdi | 416/238 X |
| 3,169,694 | 2/1965 | Borchers | 416/238 X |
| 3,444,817 | 5/1969 | Caldwell | 416/242 |
| 3,995,603 | 12/1976 | Thien et al. | 416/169 A |
| 4,358,245 | 11/1982 | Gray | 416/189 R |
| 4,871,298 | 10/1989 | Vera | 416/169 A |
| 4,900,229 | 2/1990 | Brackett et al. | 416/189 |
| 4,915,588 | 4/1990 | Brackett | 416/189 |

FOREIGN PATENT DOCUMENTS

| | | | |
|---|---|---|---|
| 2327125 | 12/1974 | Fed. Rep. of Germany | 416/245 B |
| 1183713 | 7/1959 | France | 416/189 R |
| 356691 | 9/1931 | United Kingdom | 416/DIG. 2 |
| 913620 | 12/1962 | United Kingdom | 416/242 |
| 916896 | 1/1963 | United Kingdom | 416/242 |

*Primary Examiner*—John T. Kwon

[57] ABSTRACT

The invention features an axial fan for passing air through a heat exchanger, the fan comprising a hub rotatable on an axis and a plurality of blades, each of which extend radially outward from a root portion attached to the hub to a tip portion, the blades characterized by a trailing edge angle that varies by approximately 40° or more over the radial extent of each blade. The blade trailing edge angle is preferably greater than 60° at the root region.

9 Claims, 4 Drawing Sheets

HIGH EFFICIENCY FAN

BACKGROUND OF THE INVENTION

This invention relates to axial flow fans, for example, fans designed to move a fluid such as air through a heat exchanger such as an air conditioning condenser.

When selecting an axial fan for a particular application, one of the parameters to be chosen is the non dimensional loading. Non-dimensional loading is the ratio of the change of pressure across the fan to the product the density of the fluid moved by the fan and the square of the speed of the tips of the fan blades. Since non-dimensional loading is inversely proportional to the square of the tip speed, heavily loaded fans will generally have lower tip speeds, assuming the pressure drop and fluid density are relatively constant. There are several advantages to operating a fan at lower speeds (i.e., with higher non-dimensional loading) including reduced noise and vibration levels and reduced centrifugal forces acting on the fan. In addition, limits on the diameter and the capability of a particular engine or electric motor may require that the non-dimensional loading be high.

When a heavily loaded fan is used in a given application, e.g., moving air, large tangential, or swirl velocities are imparted to the air as it moves through the fan. These swirl velocities cause centrifugal forces to act on the air as it leaves the fan. In the absence of other forces acting on the air, the air will move radially under the action of these centrifugal forces and the jet of air leaving the fan will therefore not be of constant radius, but will expand downstream of the fan.

An axial fan that is designed to push air through a compact heat exchanger, such as an air-conditioning condenser or automotive radiator, is positioned in a shroud which directs all of the air through the core of the heat exchanger. Typically, this shroud is only slightly larder than the fan itself, but is rectangular in shape rather than circular. When using a heavily loaded fan, an expanding jet of air, as discussed above, will leave the fan and impinge on the sides of the shroud rather than the core. The sides of the shroud must then turn the flow, and force the air through the edges of the core.

SUMMARY OF THE INVENTION

The invention features an axial fan which can be used to pass air through a heat exchanger without exhibiting the radial expansion seen in existing axial fans. The fan comprises a hub rotatable on an axis and a plurality of blades, each of which extend radially outward from a root portion attached to the hub to a tip portion, the blades characterized by a trailing edge angle (defined as the angle between the trailing edge of the blade and the plane of rotation) that varies by approximately 40° or more over the radial extent of each blade.

In the preferred embodiment, the blade trailing edge angle of each of the blades is at least 60° at the root region. The blades are free tipped over a majority of their chord length, and are back skewed over at least the outer 20% of the diameter. The leading edge rake of the blades at the tip is at least 5% of the nominal diameter of the blades. A water slinging ring is attached to radial projections on the blades. The hub of the fan is hollow to accommodate an electric motor or similar device. The fan has a solidity of at least 75% of the disk area and a blade chord near the root of each blade that is at least 80% of.

DETAILED DESCRIPTION OF THE PREFERRED EMBODIMENT DRAWINGS

We first briefly describe the drawings.

Figure 1:
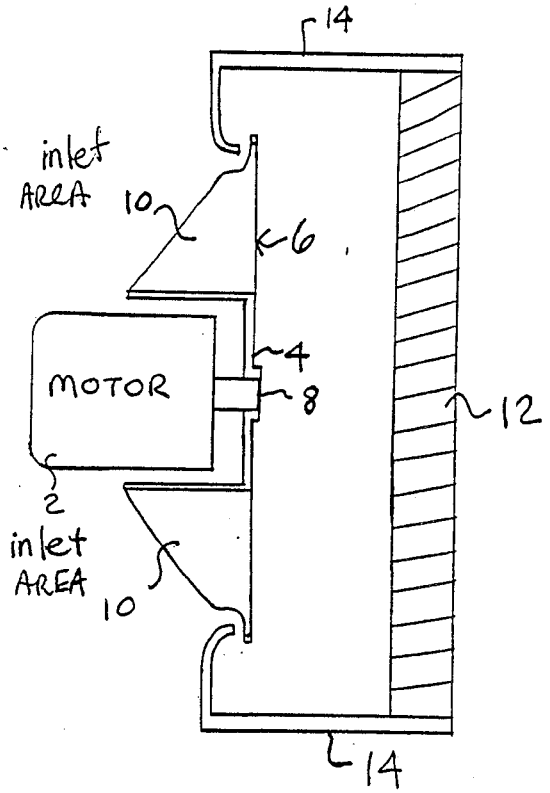
FIG. 1 is a cross-sectional view of a system using a fan according to the invention.
Figure 2:
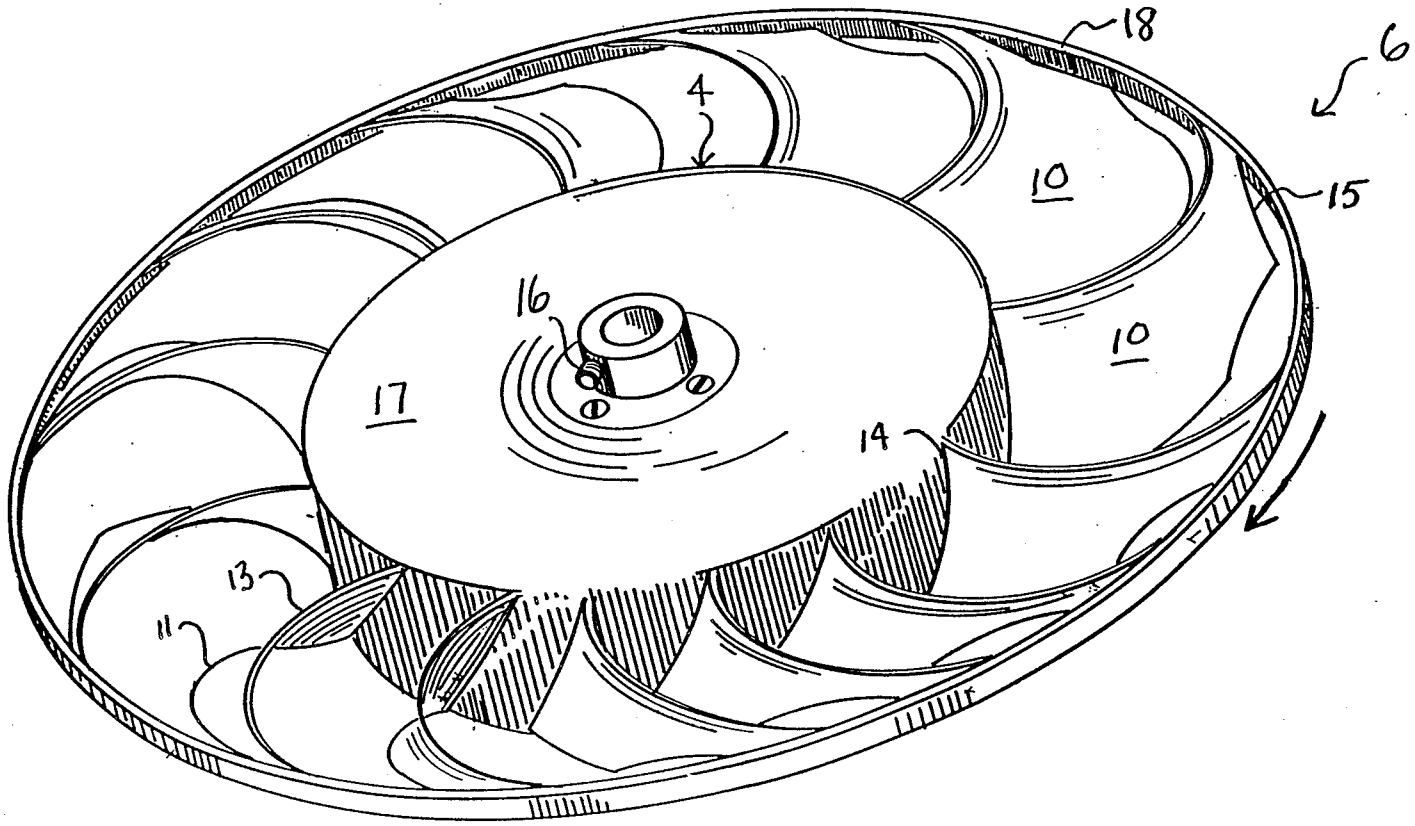
FIG. 2 is a perspective view of the fan shown in FIG. 1.
Figure 3:
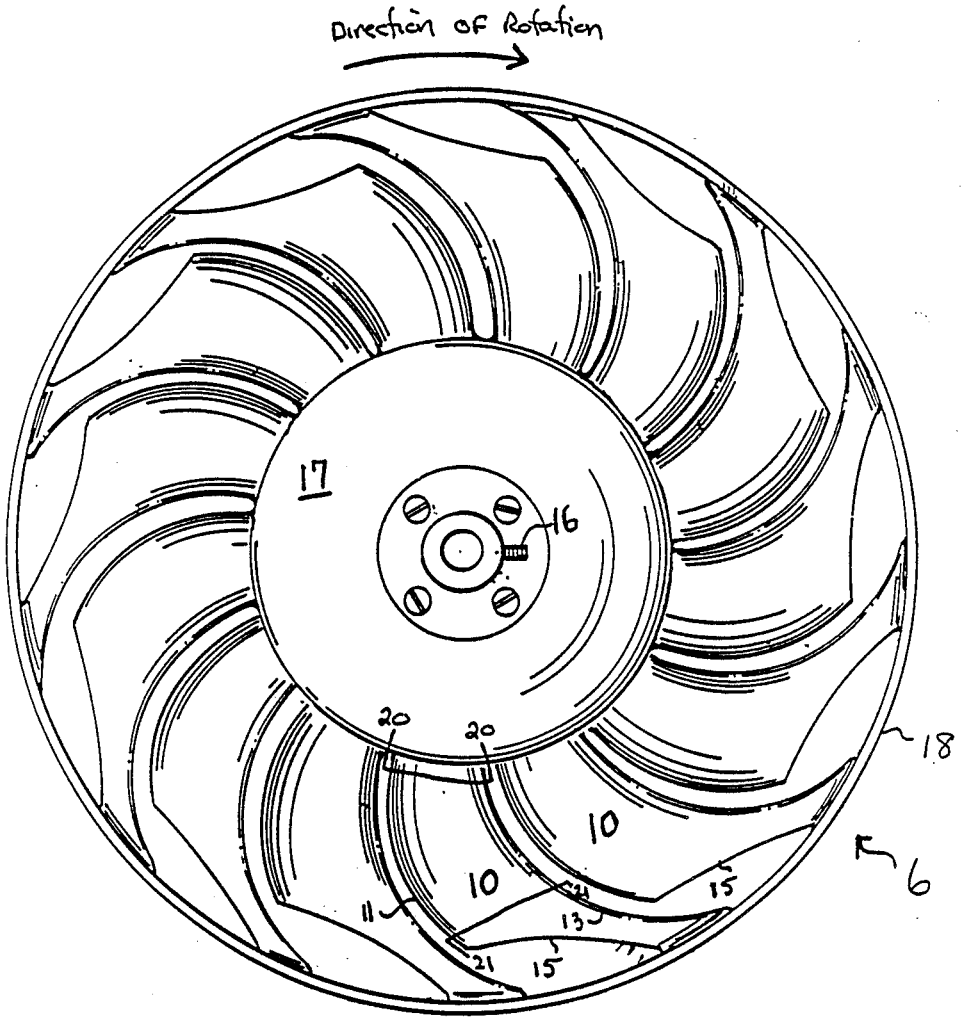
FIG. 3 is a plan view of the fan shown in FIGS. 1–2.
Figure 4A:
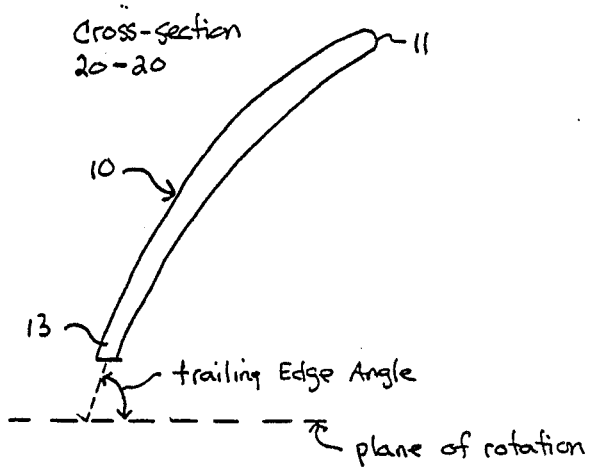
Figure 4B:
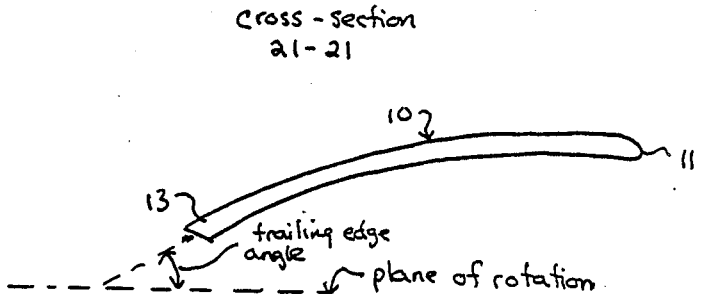

FIGS. 4A–B show two cross sections of a blade of the fan shown in FIGS. 1–3.

Structure and Operation

Referring to FIG. 1, a motor 2 drives a hub 4 of a fan 6 that rotates about an axis 8. Fan 6 includes a plurality of blades 10 that draw air from an inlet area and force the air towards a load 12 such as the condenser of an air conditioner. Shroud 14 helps prevent air that has been pushed by the fan from leaking back into the inlet area.

Referring to FIGS. 2–3, each blade 10 is back skewed and extends from a root portion 14 secured to hub 4 to an outer portion or tip 15. Each blade has a leading edge 11 and a trailing edge 13. Outer portion 15 of each blade is free over most of its length and is attached to a slinger ring 18 at its highest point. A screw 16 is used to secure fan 6 onto the shaft of motor 2.

The trailing edge angle of each of blades 10 is defined as the angle formed between the trailing edge 13 of the blade and the plane of rotation of the blade. (E.g., the front surface 17 of hub 4 defines a plane that is parallel to the plane of rotation.) The trailing edge angle decreases by more than 40° over the blade length from the root 14 to outer portion 15. In the preferred embodiment, the trailing edge angle is greatest at the root portion 14 where it is at least 60° . FIGS. 4A–B show two blade cross-sections to illustrate the change in trailing edge angle. Referring to FIG. 4A, a cross-section is shown taken along line 20—20 in FIG 3, and illustrates the trailing edge angle near root portion 14. FIG. 4B shows a cross section taken along line 21 21 in FIG. 3, and illustrates the trailing edge angle near tip portion 15. It can be clearly seen that the trailing edge angle varies by approximately 40° , and is greatest near root portion 14.

The preferred embodiment is operated at a speed such that it is heavily loaded, and can be mounted upstream in close proximity to a heat exchanger. Due to the large change in trailing edge angle over the blade length (i.e., large blade twist), the fan generates a downstream static pressure which is lower near the hub than it is near the tip of the fan. This pressure gradient will counteract radial expansion typical in heavily loaded fans, so that the air does not impinge on the sides of shroud 14. The resulting flow of air through the heat exchanger will not exhibit the extremely non uniform distribution common in prior art fans.

A further advantage is achieved by the fan's large amount of blade twist, since large blade chords can be used near the hub without overlap. In the preferred embodiment, the blade chord near the root of each blade is at least 80% of. This reduces blade loading in that portion of the fan where blade stall is most likely to be a problem, without compromising the ability of the fan to be manufactured by plastic injection molding (i.e., no overlap).

The large amount of blade twist also allows the axial projection of the blade tips to be minimized. This allows the shroud to be relatively short. This is particularly important in cases where the air must be drawn from the sides rather than from in front of the fan, since more room is then available for the flow to turn the corner and enter the fan blades.

Having blade tips which are free over at least the major portion of their chord length provides the advantage that any air that leaks through the clearance gap between the fan and the shroud does not form an organized jet which can interfere with the incoming flow. This is also particularly important in those cases where air is drawn from the sides.

The fan incorporates blade skew to reduce noise. In the preferred embodiment the skew direction is opposite the blade rotation. This type of skew ("back skew") requires that the pitch of the blades be higher near the root than near the tip, thereby increasing the amount of twist on the blade. This allows a further increase in the root chords, and a further decrease in the axial extent of the blade tips. Furthermore, the camber is less at the hub and greater at the tips of the blades. If the skew is in the direction of fan rotation ("forward skew") the pitch and camber corrections are opposite those for back skew. Finally, if the skew starts in one direction and changes to the other direction, the pitch and camber corrections must vary accordingly.

The preferred embodiment exhibits high solidity in order to minimize the possibility of blade stall. The limitations on this solidity are that the fan be moldable by plastic injection molding (i.e., there can be no overlap), and that the axial projection of the blade at the root fit the space allocated. Considering the blades up to the nominal fan radius (i.e., the radius measured to the blade tip without any projections such as the projections used to accommodate a slinging ring), the preferred solidity of the blades and hub is at least 75% of the total disk area A, calculated according to the standard formula for area, i.e.

$$A = \#r^2$$

where r is the nominal fan radius, as defined above.

The preferred embodiment also exhibits a large amount of leading edge rake at the tip sections, as shown in FIG. 1. Rake is defined as the axial position of the leading edge of the blade at a given radius relative to that at the hub radius, positive when downstream. Ideally, the rake should be a monotonically increasing function of radius. This feature allows the fan to work well in those applications where the air is drawn from the side, since the projection of the blade outside of the shroud orifice helps the air to turn the corner. The preferred amount of rake is equal to at least 5% of the nominal diameter of the blades.

Since the preferred embodiment is used in an air conditioner, a condensate slinging ring is used. The slinging ring is supported by extensions to the blades near their trailing edge and serves to distribute condensate that forms on the bottom of the air conditioner.

The preferred embodiment would incorporate a hub which is hollow on the upstream side, as shown in FIG. 1, to allow the total axial extent of the motor and fan to be minimized.

The above described embodiment is merely illustrative of the invention, and other embodiments are within the scope of the appended claims.

I claim:

1. An apparatus comprising:

a heat exchanger; and an axial fan positioned in close proximity to said heat exchanger in a position to push air through said heat exchanger, said fan comprising a hub rotatable on an axis and a plurality of blades, each of which extends from a root portion attached to said hub to a tip portion, each of said blades having a trailing edge angle of approximately 60° or more at said root portion, said trailing edge angle varying by approximately 40° or more over the radial extent of each blade, wherein rotating said hub on said axis moves said blades thereby pushing air through said heat exchanger.

2. The apparatus of claim 1 wherein each of said blades is skewed.

3. The apparatus of claim 2 wherein each of said blades is back skewed.

4. The apparatus of claim 3 wherein each of said blades is back skewed over at least the outer 20% of its diameter.

5. The apparatus of claim 1 wherein said fan has a solidity equal to approximately 75% or more of the disk area.

6. The apparatus of claim 1 wherein the loading edge make of each of said blades at said tip portion is equal to approximately 5% or more of the nominal diameter of said blades.

7. The apparatus of claim 1 further comprising a slinging ring attached to said blades.

8. The apparatus of claim 1 wherein the blade chord at said root portion is approximately 80% or more of a maximum blade chord.

9. An axial fan and means for supporting said fan in association with a heat exchanger, said fan comprising a hub rotatable on an axis and a plurality of blades, each of which extends from a root portion attached to said hub to a tip portion, each of said blades having a trailing edge angle of approximately 60° or more at said root portion, said trailing edge single a varying by approximately 40° or more over the radial extent of each blade, wherein rotating said hub on said axis moves said blades thereby pushing air through said heat exchanger.

* * * * *